United States Patent [19]

Pradon

[11] 4,013,140

[45] Mar. 22, 1977

[54] SAFETY EQUIPMENT

[76] Inventor: Jacques Pradon, 19 avenue de la Tourelle, Saint-Maur-Des-Fosses, France

[22] Filed: Oct. 30, 1975

[21] Appl. No.: 627,036

[30] Foreign Application Priority Data

Oct. 31, 1974 France ..... 74.36513
Sept. 30, 1975 France ..... 75.29935

[52] U.S. Cl. ..... 182/1; 182/106; 182/129; 182/137

[51] Int. Cl.[2] ..... E06C 5/36; E06C 7/18

[58] Field of Search ..... 182/1, 86, 106, 129, 182/137, 138, 130, 131, 132

[56] References Cited

UNITED STATES PATENTS

| | | | |
|---|---|---|---|
| 862,152 | 8/1907 | German | 182/47 |
| 1,944,159 | 1/1934 | Bailey | 182/1 |
| 2,531,001 | 11/1950 | Short | 182/1 |
| 3,731,761 | 5/1973 | Glenn | 182/1 |
| 3,949,834 | 4/1976 | Nusbaum | 182/138 |

*Primary Examiner*—Reinaldo P. Machado

[57] ABSTRACT

Safety equipment for a station at which access is gained to the tops of vehicles of differing heights comprising a platform alongside which a vehicle is located, an access installation articulated on the platform and movable between an inoperative position away from the vehicle and an operative position bearing on that side of the vehicle closer to the platform, and a protective panel installation articulated by arms on the platform and movable between an inoperative position away from the vehicle and an operative position bearing on that side of the vehicle remote from the platform.

12 Claims, 12 Drawing Figures

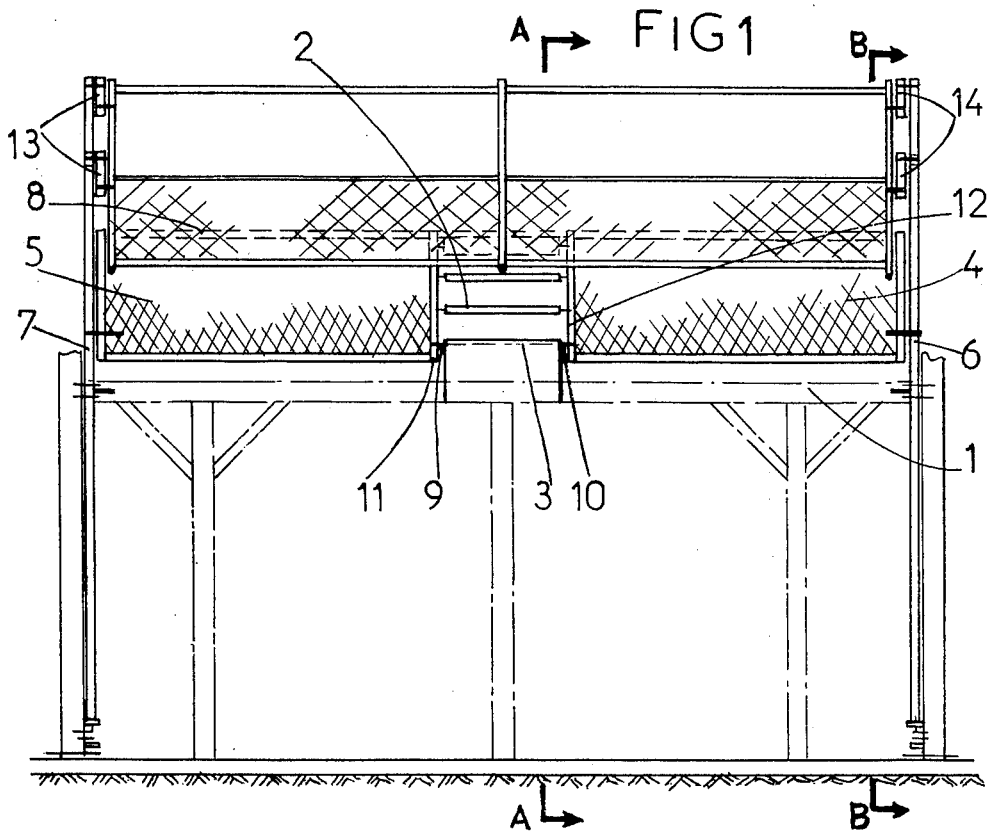
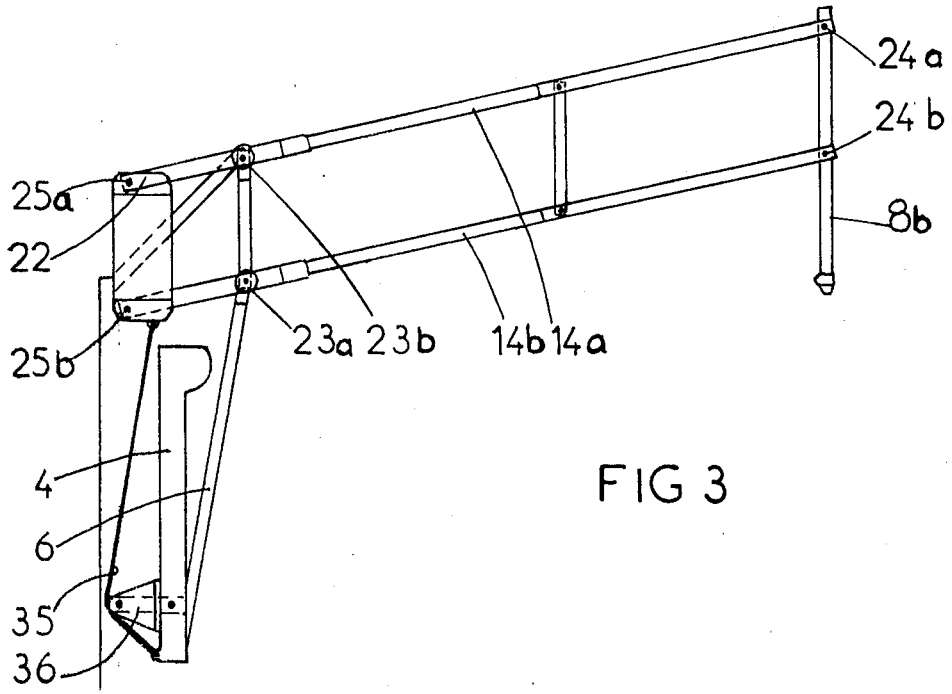
FIG 3

FIG 8
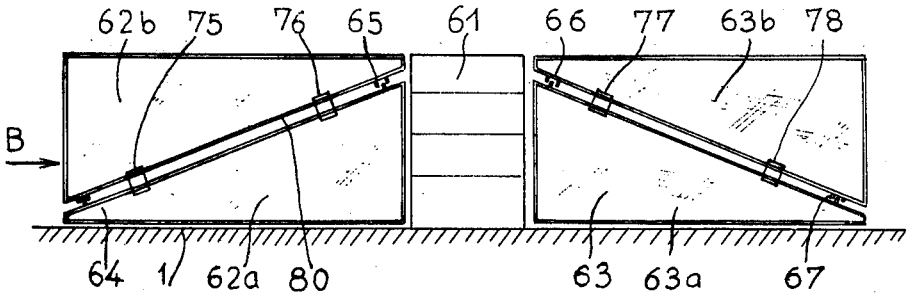
FIG 9
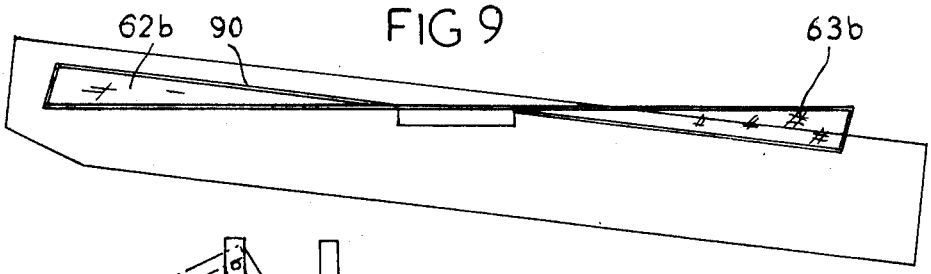
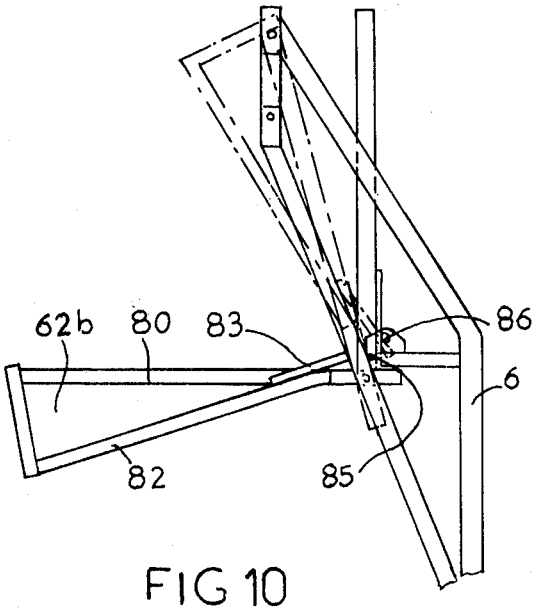
FIG 10
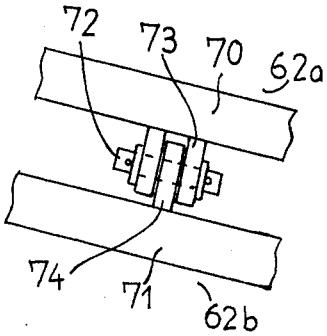
FIG 11
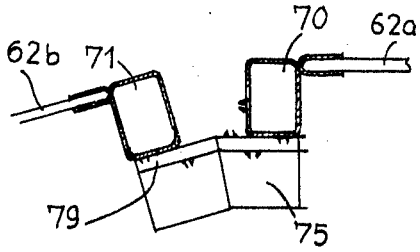
FIG 12

SAFETY EQUIPMENT

The present invention relates to safety equipment for a station at which access is gained to vehicles of various heights. The saftey equipment is applicable more particularly to a hydrocarbon loading station for tanker trucks.

An access, loading or charging station of this kind generally comprises a platform at a level intermediate the levels of the top of the highest vehicle and the top of the lowest vehicle.

One end of a means for giving access to the vehicle, e.g., a flight of steps or a ramp, is articulated to this platform, the other end being adapted to rest on the top of a vehicle stationed in the loading, charging or access station alongside the platform.

A known access means allowing two positions at different levels to be connected, e.g., a platform and a vehicle, comprises an articulated flight of steps whose treads remain horizontal irrespective of the inclination of the steps, the flight of steps forming a pivoted assembly movable between a disengaged position in which the flight of steps is moved away from the vehicle, and an operative position in which it bears on the side of the vehicle, closer to the platform, hereafter called the inner side of the vehicle, the movement being readily effected by pulling or pushing the handrail of the flight of steps, as the weight of the steps is balanced by a counterweight.

In the case of a station for loading tanker trucks, the flight of steps of this type an enable an operator to reach the top of the tanks of the truck from a platform situated at a level higher or lower than the top of the tank. However, when he is on the top of the tank, which is a curved and smooth surface, the operator may slip and fall from the vehicle while handling the filling hoses.

This known installation therefore has the disadvantage of being dangerous for the operator.

It is an object of the invention, therefore, to provide safety equipment which is easy to handle and offers every guarantee of safety for an operator in a station providing access to the tops of vehicles of different heights.

According to the present invention there is provided safety equipment for a station providing access to the tops of vehicles of different heights, the equipment comprising:

a platform alongside which a vehicle is to be located;

access means;

means for ariticulating said access means on said platform, said access means forming a pivotal assembly movable between an inoperative position away from the vehicle and an operative vehicle in which it bears on that side of the vehicle closest to said platform;

a fist protective system comprising first protective panel means;

means for articulating said first panel means on said platform and comprising arm means articulated to said first panel means and to support means on said platform, said first panel means being movable between an inoperative position away from said vehicle and an operative position in which it bears on that side of the vehicle remote from said platform.

When the width of the access means is small in relation to the vehicle length, said access means may be continued laterally by a second system including panel means for protecting the side of the vehicle closest to the platform, said second system being movable with said access means to a position in which it bears on the vehicle. The operator will thereby be protected from falling into the space between the vehicle and the platform. The lengths of said first and second protective panel means are so selected as to ensure safety over the entire length of the longest vehicles which may arrive at the station.

In order that the invention may be more readily understood, embodiments of equipment according to the invention in a loading station for tanker trucks will now be described, by way of example only, with reference to the accompanying drawings.

In the drawings:

FIG. 1 is a side elevation of an access station including an embodiment of equipment according to the invention;

FIG. 3 is a section taken on line B—B of FIG. 1;

FIG. 8 is a top plan view of a further modification of the equipment of FIG. 1.

FIG. 9 is a side elevation showing the modification of FIG. 8 in operative position on an inclined tanker;

FIG. 10 is a side view of the modification of FIG. 8 seen in the direction of the arrow B in FIG. 8;

FIG. 11 is an enlarged-scale view of part of the modification of FIG. 8; and FIG. 12 is a section taken on line C—C of FIG. 8.

Figure 2:
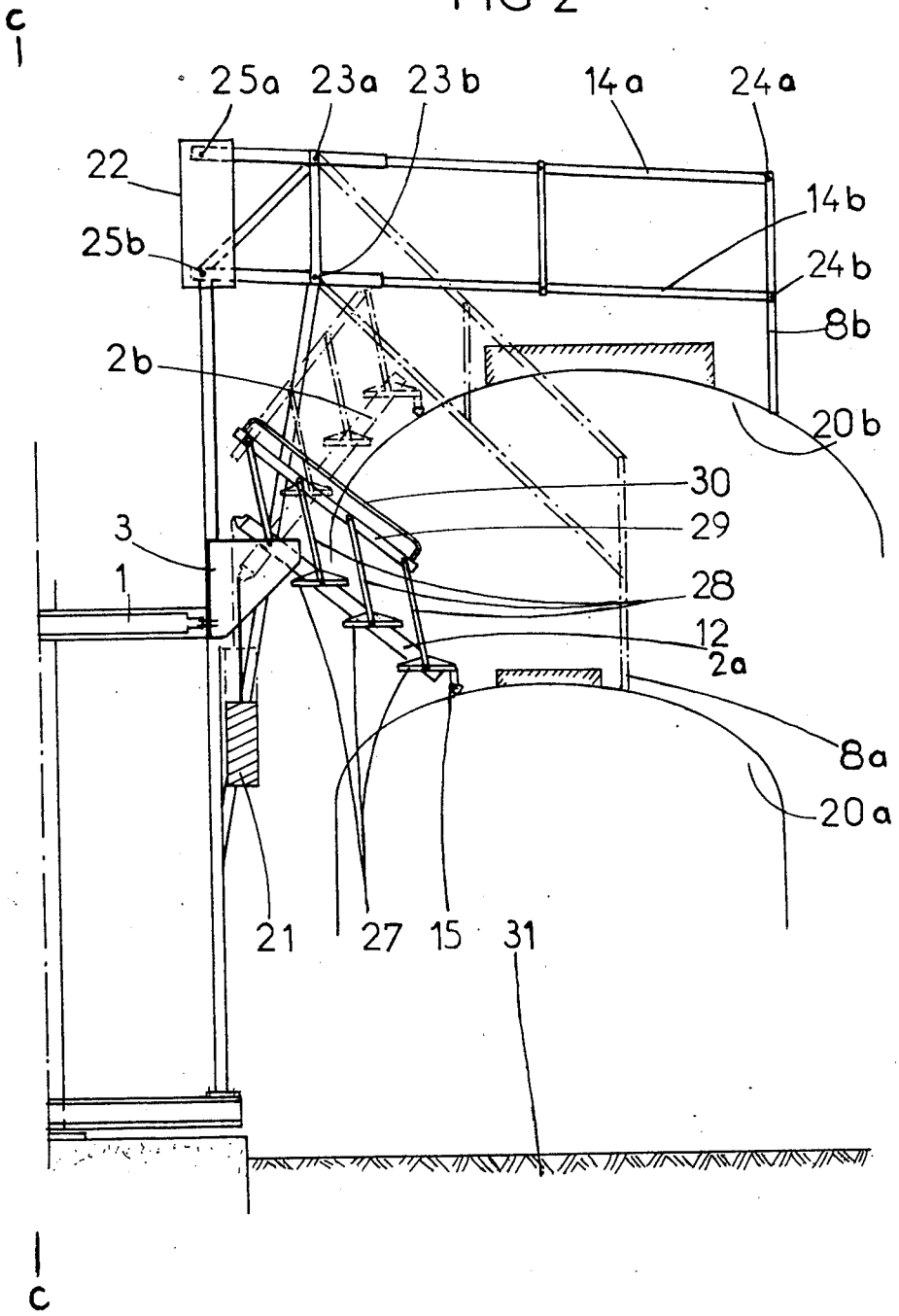
FIG. 2 is a section taken on line A—A of FIG. 1.

FIG. 1 shows an elevated platform 1 of an access, loading or charging station and a flight of steps 2 articulated at 9 and 10 on a top step 3 connected to the platform 1. Inner protective lattice-work panels 4 and 5, forming a lateral continuation of the flight steps 2, are secured to the strings 11 and 12 of the steps. Fixed arms 6 and 7 connected to the platform 1 support an outer lattice work panel 8 through the agency of articulated linkages 13 and 14.

Referring to FIG. 2 the top parts of two tanker trucks **20*a* and 20*b* of different heights are shown in the loading position on a track 31 of the station. FIG. 2 also shows the corresponding positions 2*a* and 2*b* of the flight of steps 2 bearing on the tanker trucks through a bottom projecting part 15** connected to the last step of the flight.

The outer protective panel 8 is shown in its operative position **8*b* corresponding to the position 2*b* of the flight of steps, i.e. in position on the tanker trucks 20*b***.

The outer protective panel 8 is supported by the linkages 13 and 14 which are in the form of a parallelogram linkage. As shown, linkage 14 is formed by arms **14*a* and 14*b* articulated on the support of the panel 8 at 24*a* and 24*b* and on the end of the fixed arm 6 at 23*a* and 23*b*. Linkage 13 is identical to linkage 14**.

It will be seen therefore that the panel 8 will move in parallel relationship to itself by deformation of the parallelograms formed by the articulated arms supporting it, when said arms undergo rotation, for example, to move the panel 8 from position **8*b* to position 8*a*. In particular, the panel 8 will always remain vertical. The arms 14*a* and 14*b* carry a counterweight 22**, which is articulated at 25*a* and 25*b* on the arms 14*a* and 14*b* and is arranged to balance the weight of the panel 8 and its supporting arms. The articulated flight of steps 2 comprises two strings 11 and 12, articulated on the top step 3 which is connected to the platform 1. The flight of steps comprises treads 27, uprights 28 and rails 29 surmounted by a handrail 30. The treads, which are connected at the center to the lower parts of the uprights, are articulated on the strings and the upper parts of the uprights are also articulated on the rails 29. With this arrangement, the treads 27 can be kept horizontal irrespective of the position of the flight of steps 2, the first upright being connected to the fixed top step 3. A counterweight 21 secured to the strings balances the weight of the flight of steps and its panels 4 and 5.

FIG. 3 shows the articulated linkage 14 formed by the arms 14*a* and 14*b* articulated at 23*a* and 23*b* on the arm 6 and bearing the panel 8 at one end and a counterweight 22 on the other end. The panel 4 connected to the string 12 of the flight of steps 2 is connected at the bottom to one end of a chain (or cable) 35 which passes over a cam 36 connected to the panel 4 and is connected by its other end to the counterweight 22. At the other side of the installation the panel 5 is connected in the same way to the end of the articulated arm 13.

The pivoted assembly formed by the flight of steps 2 and the panels 4, 5 is shown in its disengaged or inoperative position in FIG. 3. If the flight of steps and the two panels 4 and 5 forming the pivoted assembly is pivoted downwardly to its operative position on a tanker truck, pivoting of each panel will cause the respective chain to slacken and this will result in the linkages 13, 14 to cause the panel 8 to drop in pivoting of parallel relationship to itself until its rests on that side of the tanker lorry opposite the access platform.

The length of each chain or cable, e.g., 35, is so selected that the steps do not rest on the tanker truck until the panel 8 is already resting thereon.

If the flight of steps is now pivoted upwardly, the panel 8 lifts with a slight delay due to the delay in the tension of the connecting chains. The movement of the flight of steps 2 and of the panels 4 and 5 forming the pivoted assembly is obtained without undue force simply by pulling or pushing on the handrail of the steps, because the flight or steps 2 is balanced by the counterweight 21. The movement of the panel 8, balanced by the counterweight 22, as a result of the movement of the steps is also obtained without undue force by the tensioning or slackening of the chains as a result of rotation of the steps.

It will be seen that if an operator wishes to reach the top of a tanker truck in position in the access station, he will have to operate the pivoted assembly formed by the flight of steps 2 and the two panels 4 and 5 by pushing on the handrail of the steps in its inoperative position, so that they are lowered until the pivoted assembly rests on the top of the tanker truck. This movement of the pivoted assembly will automatically cause the outer panel 8 to swing down, so that all the means required for the operator's safety are automatically in position when the flight of steps is resting on the tanker truck.

The system is therefore completely reliable while being very easy to operate.

Only one access station has been described but a loading installation of the type described will generally comprise two indentical stations which are symmetrical with respect to the vertical plane CC in FIG. 2.

The inner and outer protective systems in the form of panels are particularly suitable in cases in which the vehicles at the access station, for example, tanker trucks at a hydrocarbon loading station, have a top surface of cylindrical shape with a horizontal generatrix, because the edges of the panels resting on the top part of the vehicle which is always designed to be horizontal will rest thereon along a generatrix, contact being perfect over the entire length of the panel. However, in the case of an inclined tanker truck, where, for example the front part is at a higher lever than the rear part, at the loading station the edges of the panel which rest on the top part of the tanker truck no longer come into contact with the tank over the entire length because the generatrix of the top cylindrical part of the tank is inclined to the horizontal. In such a case, free spaces are left between the safety panels and the tank which are a danger to the operator, and the panels cannot assume a stable position of rest on the tank.

To obviate these disadvantages in the case of inclined tanks, at least one of the inner and outer protective systems is formed by an assembly of articulated panels, and the relative movements of the panels allowed by the joints therebetween enable the panels to assume the same inclination as the vehicle inclination.

Figure 4:
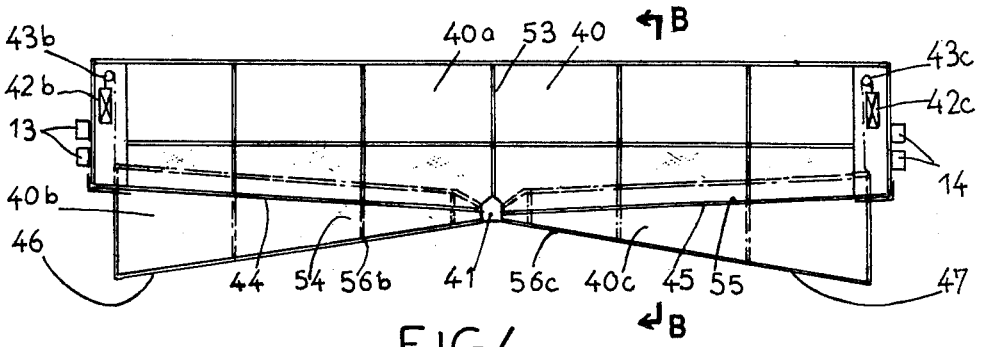
FIG. 4 is a side elevation similar to FIG. 1 showing a modification of the equipment of FIG. 1 for use with an inclined tanker.

Referring to FIG. 4, an articulated outer safety panel 40 is supported by the linkages 13 and 14 which are in turn articulated on fixed arms 6 and 7 connected to the platform as shown in FIG. 1. Panel 40 comprises three parts, a main panel 40*a* connected to the linkages 13 and 14 and two relatively inclinable panels 40*b* and 40*c* parallel to the panel 40*a* and connected to the latter at 41 by an articulated joint allowing the two panels 40*b* and 40*c* to rotate in parallel relationship to the panel 40*a*. The panels 40*b* and 40*c* are held in a stable position in relation to the panel 40*a* by means of counterweights 42*b* and 42*c* connected to the panels 40*b*, 40*c* respectively by cables or the like passing over pulleys 43*b* and 43*c* carried by the panel 40*a*. The bottom edge of the panel 40*a* is formed of two parts 44 and 45 inclined to the horizontal. In the raised position of the panel 40, i.e., when the panel is in the inoperative position as shown in FIG. 4, the panels 40*b* and 40*c* are held in bottom positions by their own weight, the counterweights 42*b*, 42*c* being locked in their top positions by stops connected to the panel 40*a*. In this position, the inclinable panels 40*b* and 40*c* form the bottom part of the panel 40, their bottom edges 46 and 47 forming the bottom edges of the panel 40. The panels 40*a* and 40*c* each comprise a casing and a framework formed by welded bars, which rigidify the panels, and lattice-work plates secured to the framework.

Figure 5:
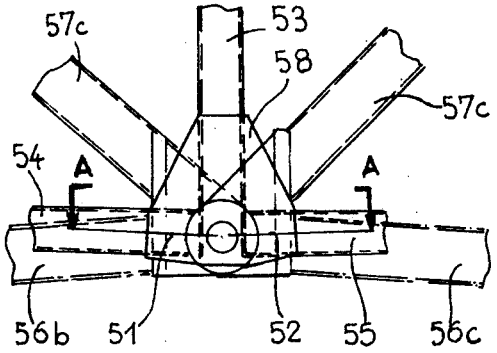
FIG. 5 is an enlarged-scale view showing part of modification shown in FIG. 4.
Figure 6:
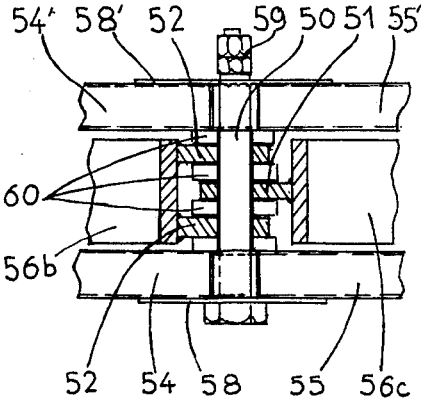
FIG. 6 is a section taken on line A—A of FIG. 5.

FIGS. 5 and 6 are enlarged-scale views showing the arrangement of the bars of the frameworks of the panels 40*a*, 40*b* and 40*c* at the joint 41. The main panel 40*a* is formed by a double framework comprising bars 53, 54, 55 and 53', 54' and 55' at the joint 41, said bars being connected by angle members 58 and 58' respectively. The two parts of the framework of the panel 40*a* are spaced apart as will be seen in FIG. 6 and panel 40*a* is therefore in the form of a double panel with a central space to allow guidance of the inclinable panels 40*b*, 40*c* as will be seen in FIG. 7. Framework bars 56*b* and 57*b* of the panel 40*b* are connected by an angle member 51 at the joint 41. Similarly, framework bars 56*c* and 57*c* of the panel 40*c* are connected by an angle member 52.

FIG. 6 shows a pivot 50 connected to the main panel 40*a* perpendicular thereto and extending through the central space inside the panel 40*a*. The pivot 50 is in the form of a bolt clamped to the panel 40*a* by a nut 59. The angle members 51 and 52 and spacer washers 60, allowing rotation of the angle members 51 and 52 and hence of the panels 40*b* and 40*c* with respect to the panel 40*a*, are rotatably mounted on the pivot 50.

Figure 7:
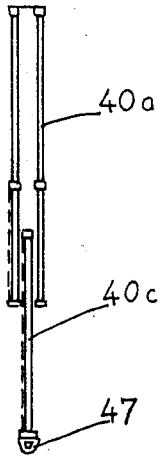
FIG. 7 is a section taken on line B—B of FIG. 4.

FIG. 7 shows the panel 40*c* partially engaged inside the central space formed in the double panel 40*a*. When it moves as a result of rotation, the panel 40*c* moves inside this space which thus guides the panel 40*c*. The same applies to guidance of the panel 40*b*. It will be seen that the bottom edge of the panel 40*c*, which is intended to rest on the top part of the vehicle at the loading station, has a rounded part 47.

FIG. 8 shows a pivoted assembly formed by an articulated flight of steps 61 and articulated inner safety panels 62 and 63. Each of the two rectangular panels 62 and 63 is formed by two triangular panels 62*a* and 62*b* in the case of panel 62 and 63*a* and 63*b* in the case panel 63. Panels 62*a* and 63*a* are connected rigidly to the string of the flight of steps 61 and are therefore fixed with respect to the steps. The panels 62*b* and 63*b* are connected to the panels 62*a* and 63*a* respectively by articulations 64 and 65 and 66 and 67 respectively.

FIG. 11 shows an enlarged-scale view of the articulation 64. This articulation comprises a pivot 72 fixed to a support element 73 secured to a framework bar 70 of the panel 62*a* and a member 74 rotatably mounted on the pivot 72 and connected to a framework bar 72 of the movable panel 62*b*. Stops 75 and 76 are mounted on the panel 62 and limit the inclination of the panel 62*b* with respect to the panel 62*a*. Similarly, stops 77 and 78 on panel 63 limit the rotation of panel 63*b* with respect to panel 63*a*. A detail of the stop 75 is shown in FIG. 12.

The stop 75 is connected to the bar 70 and has a supporting surface 79 on which the bar 71 is panel 62*b* bears after a certain downward rotation corresponding to the maximum inclination of the panel 62*b* with respect to the panel 62*a*.

FIG. 10 shows the arm 6 secured to the platform of the access station, on which there is articulated the end of the panel 62*a* opposite to that end connected to the string of the flight of steps. In this figure, panel 62 is shown in various stages during lifting from the position in which it bears on a vehicle to its inoperative position. Bar 82 of the movable panel 62*b* bears a cam 83 at its end, said cam being rigidly secured thereon. Arm 6 bears two stops 85 and 86 formed by pins projecting towards the end of the panel 62*b* and cooperating with the cam 83 to maneuver the movable panel 62*b* at the end of its lifting movement into the vertical position of the pivoted assembly.

The operation of the safety system comprising aricu-lated inner and outer panels will now be described with reference to its use in conjunction with an inclined tanker.

FIG. 9 shows a tanker 90 of this kind in position at the loading station, the front part of the tanker 90 being at a higher level than the rear part. When the tanker takes up position at the loading station, the pivoted assembly formed by the articulated flight of steps and the safety panels is in the vertical position, the movable parts of the inner safety panels are held in continuation of the fixed parts of these safety panels, the cam 83 and its counterpart situated on the panel 63*b* being in contact with the stops 85 and 86 which hold the movable panel in the vertical position. The outer panel 40, the movements of which are linked to that of the pivoted assembly, is in its top position. To get to the roof of the tanker in order to carry out the filling operations, the operator pushes on the handrail of the articulated steps to lower the same until they come into contact with the top of the tanker. This rotary movement of the pivoted assembly results in a lowering movement of the outer panel. If we assume that the higher side of the inclined tanker is on the side of the movable panel 40*b* of the outer safety panel, the bottom edge 46 of this panel 40*b* will be the first to come into contact with the tanker. The outer panel continues to descend with the edge 46 of the panel 40*b* resting on the top of the tanker until, by rotation of the panel 40*b* about the articulation 41, the edge 46 comes to a position in which it follows the inclination of the tanker. At the same time, rotation of the panel 40*c* about the articulation 41 enables the inclination of the bottom edge 47 of the panel 40*c* to be adjusted to the inclination of the tanker. The fact that the panels 40*b* and 40*c* are balanced by counterweights enables them to be rotated about the articulation 41 without a higher pushing force. When the outer safety panel 40 is in position on the tanker, the edges 46 and 47 of the movable panels 40*b* and 40*c* respectively are in continuation of one another and follow the inclined generatrix of the tanker. There is therefore no longer any dangerous free space between the panel 40 and the inclined tanker.

During the rotary movement of the pivoted assembly, the inner safety panels connected to the strings of the articulated flights of steps will themselves come into contact with the inclined tanker. At the start of the rotary movement of this pivoted assembly, the cams, e.g., 83, connected to the edges of the panels 62*b* and 63*b* start to slide on the stops, e.g., 85 and 86, and then leave these stops. The movable panels 62*b* and 63*b* have thus undergone a rotation as a result of their own weight until the bottom edge of their framework bar, e.g., 71, has come into contact with the stop, e.g., 75, connected to the panel 62*a*, 63*a* respectively, secured to the string of the flight of steps.

If we assume that the higher part of the inclined tanker is on the side of the panel 62*b*, this panel will be the first to come into contact with the top of the tanker. The movement of the pivoted assembly continues and the panel 62*b* will undergo rotation in the upward direction until its bottom edge is completely in contact with the top of the tanker. During the descent of the pivoted assembly, the panel 63*b* will also come into contact with the tanker and the inclination of its bottom edge also adjusts to the inclination of the tanker by rotation of the panel 63*b* about the articulations 77 and 78 connecting it to the panel 63*a*.

FIG. 9 shows the pivoted assembly in position on an inclined tanker 90. In this position, the panel 62*b* is lifted with respect to the panel 62*a* *while the panel 63b* has remained in a lowered position in relation to the panel 63*a*, and the bottom edges of the movable panels 62*b* and 63*b* approximately follow the inclined generatrix of the tanker 90. There is therefore no dangerous free space for the operator between the pivoted assembly and the tanker.

The maximum inclination that the edges 46 and 47 of the outer safety panel can assume is governed by the inclination to the horizontal of the bottom edges 44 and 45 of the main panel 40*a*. This inclination of the edges 44 and 45 of the main panel 40*a* must therefore be determined according to the maximum inclination of the tankers which may arrive at the loading station. In the case of a tanker having the maximum inclination, the outer panel will rest on the tanker by the bottom edge of one of the movable panels, and the bottom edge of the main panel situated on the side of the other movable panel.

Similarly, the maximum downward rotation of the panels 62*b* and 63*b* with respect to the panels 62*a* and 63*a* is governed by the maximum inclination of the tankers which may arrive at the loading station.

The invention is not intended to be limited to the above-described embodiments but covers all variants and modifications which are possible in respect of detail or in respect of the use of equivalent means without thereby departing from the scope of the invention. For example, if the vehicles arriving at a station have heights which are only slightly different from one another there is no need to provide parallelogram articulation arms to suspend the outer protective panel because the inclination of this panel will vary only slightly from one vehicle to another.

In the case of the equipment adapted to inclined tankers, the outer safety panel may comprise a single balanced inclinable panel which is secured rotatably at its central part on the central part of the main panel, the bottom edge of which resting on the tanker may assume the inclination of the generatrix of said tanker by rotation of the movable panel. It is also possible to devise other systems than those described to limit the rotation of the movable panels of the inner safety system or to restore these panels to the vertical position at the end of the upward movement of the pivoted assembly. Finally, although the safety system has been described with reference to a hydrocarbon loading station for tanker trucks, such equipment is of course applicable to an access station for vehicles of any type. For example, it is applicable to a station where vehicles are loaded by operatives using ramp planks.

I claim:

1. Safety equipment for a station providing access to the tops of vehicles of different heights, the equipment comprising:

a platform alongside which a vehicle is to be located;

support means on said platform;

access means;

means for articulating said access means on said platform, said access means comprising a pivotal assembly movable between an inoperative position away from the vehicle and an operative position in which it bears on that side of the vehicle closest to said platform;

a first protective system comprising first protective panel means; and means for articulating said first panel means on said platform and comprising arm means articulated to said first panel means and to said support means on said platform, said first panel means being movable between an inoperative position away from said vehicle and an operative position in which it bears on that side of the vehicle remote from said platform.

2. Safety equipment according to claim 1, wherein said arms means comprises parallelogrm linkages whereby said panel means is maintained at a constant inclination irrespective of the height of the vehicle on which it bears.

3. Safety equipment according to claim 1, wherein said access means is continued laterally by a second system comprising second protective panel means which is movable together with said access means to bear on the vehicle.

4. Safety equipment according to claim 3, wherein said access means comprises an articulated flight of steps with strings, said second protective panel means being secured to the strings of said flight of steps.

5. Safety equipment according to claim 1, comprising means for linking the movement of said arm means of said first panel means to movement of said pivotal assembly.

6. Safety equipment according to claim 5, wherein said linking means comprises a chain.

7. Safety equipment according to claim 3, wherein at least one of said first and second protective systems comprises an assembly of panels which are articulated with respect to one another, relative movement of said articulated panels enabling edges of said panels coming into contact with the vehicle to assume an inclination relative to that of the vehicle.

8. Safety equipment according to claim 7, wherein said first protective panel means comprises a main panel connected to said support by said articulated arm means and at least one relatively inclinable panel parallel to said main panel and forming a continuation of the bottom part of said main panel, said inclinable panel being rotatably fixed to said main panel by means of a pivot perpendicular to said panels, rotation of said inclinable panel relative to said main panel allowing adjustment of the inclination of the bottom edge of said inclinable panel coming into contact with the vehicle relative to the inclination of the vehicle.

9. Safety equipment according to claim 8, including two inclinable panels of triangular shape balanced by counterweights and each connected near one of the apices to the central part of the bottom edge of said main panel by said pivot.

10. Safety equipment according to claim 7, comprising two second protective panel means each in the form of a quadrilateral and comprising two triangular panels articulated along that diagonal of the panel means joining the apex adjacent said access means and which will rest on the vehicle at the apex adjacent the platform and remote from said access means, one of said panels being rigidly secured to said access means by one of its sides and the other panels being rotatable about its side articulated to said one panel.

11. Safety equipment according to claim 10, including stop means for limiting rotation of each said other panel relative to said one panel and disposed on those sides of said panels which are articulated to one another.

12. Safety equipment according to claim 10, including cams disposed on one of the sides or each other panel other than said articulated side and cooperating with stops disposed on supports secured to said platform for restoring said other panels to the vertical when said pivoted assembly is in its inoperative position.

* * * * *